US011001953B2

(12) United States Patent
Kim et al.

(10) Patent No.: US 11,001,953 B2
(45) Date of Patent: May 11, 2021

(54) WASHING MACHINE

(71) Applicant: SAMSUNG ELECTRONICS CO., LTD., Suwon-si (KR)

(72) Inventors: Do Haeng Kim, Suwon-si (KR); Young-Hyun Kim, Suwon-si (KR); Geon Ho Lee, Incheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 342 days.

(21) Appl. No.: 15/847,277

(22) Filed: Dec. 19, 2017

(65) Prior Publication Data

US 2018/0179682 A1 Jun. 28, 2018

(30) Foreign Application Priority Data

Dec. 23, 2016 (KR) ..... 10-2016-0178546

(51) Int. Cl.
*D06F 29/00* (2006.01)
*D06F 37/06* (2006.01)
(Continued)

(52) U.S. Cl.
CPC ..... *D06F 29/00* (2013.01); *D06F 25/00* (2013.01); *D06F 31/00* (2013.01); *D06F 37/06* (2013.01);
(Continued)

(58) Field of Classification Search
CPC ..... D06F 37/24; D06F 39/04; D06F 39/02; D06F 37/22; D06F 39/14; D06F 39/088;
(Continued)

(56) References Cited

U.S. PATENT DOCUMENTS

2009/0158784 A1* 6/2009 Kim ..... D06F 39/083 68/27
2010/0275381 A1 11/2010 Ko et al.
(Continued)

FOREIGN PATENT DOCUMENTS

| | | | |
|---|---|---|---|
| EP | 2 065 505 | A1 | 6/2009 |
| EP | 2065505 | A1 | 6/2009 |
| KR | 20-134138 | | 4/1999 |
| KR | 10-2008-0109488 | | 12/2008 |
| KR | 10-2009-0054787 | | 6/2009 |
| WO | WO 2008/084932 | A2 | 7/2008 |

OTHER PUBLICATIONS

European Patent Office issued European Search Report (Communication under Rule 71(3) EPC in European Patent Application No. 17206092.3 dated Oct. 10, 2018 (5 pages).
(Continued)

*Primary Examiner* — Benjamin L Osterhout
(74) *Attorney, Agent, or Firm* — Staas & Halsey LLP

(57) ABSTRACT

A washing machine is provided. The washing machine includes a first housing; a second housing disposed on the first housing; a first tub covered by the first housing and having a first opening formed at a front surface; a second tub covered by the second housing and having a second opening formed at an upper surface; a drain path provided to drain wash water of the first tub and wash water of the second tub and having at least one portion located at a position higher than a maximum water storage height of the second tub; and a connector coupled to the first housing and disposed at one portion of the drain path where wash water of the first tub and wash water of the second tub are joined.

23 Claims, 13 Drawing Sheets

(51) Int. Cl.

| | |
|---|---|
| ***D06F 37/18*** | (2006.01) |
| ***D06F 37/24*** | (2006.01) |
| ***D06F 37/22*** | (2006.01) |
| ***D06F 39/08*** | (2006.01) |
| ***D06F 39/04*** | (2006.01) |
| ***D06F 39/14*** | (2006.01) |
| ***D06F 39/10*** | (2006.01) |
| ***D06F 39/02*** | (2006.01) |
| ***D06F 25/00*** | (2006.01) |
| ***D06F 31/00*** | (2006.01) |

(52) U.S. Cl.
CPC ..... *D06F 37/18* (2013.01); *D06F 37/22* (2013.01); *D06F 37/24* (2013.01); *D06F 39/02* (2013.01); *D06F 39/04* (2013.01); *D06F 39/083* (2013.01); *D06F 39/085* (2013.01); *D06F 39/088* (2013.01); *D06F 39/10* (2013.01); *D06F 39/14* (2013.01)

(58) Field of Classification Search
CPC ..... D06F 39/10; D06F 31/00; D06F 37/06; D06F 39/085; D06F 39/083; D06F 37/18; D06F 25/00; D06F 29/00
See application file for complete search history.

(56) References Cited

U.S. PATENT DOCUMENTS

2010/0287712 A1 11/2010 Pyo et al.
2011/0174021 A1* 7/2011 Lee ..... D06F 39/022 68/17 R
2011/0265524 A1* 11/2011 Kim ..... D06F 39/08 68/13 R
2012/0138106 A1* 6/2012 Fountain ..... A47L 15/4206 134/111
2013/0047677 A1* 2/2013 Han ..... D06F 39/14 68/27
2015/0135777 A1 5/2015 Cho
2016/0215432 A1 7/2016 Kim

OTHER PUBLICATIONS

Canadian Office Action dated Jul. 18, 2019 in related patent application No. 3,048,166 (4 pages).
International Search Report dated Mar. 23, 2018 in corresponding International Application No. PCT/KR2017/014212.
Extended European Search Report dated Apr. 9, 2018 in corresponding European Patent Application No. 17 206 092.3.

* cited by examiner

WASHING MACHINE

CROSS-REFERENCE TO RELATED APPLICATION(S)

This application claims the benefit of Korean Patent Application No. 10-2016-0178546, filed on Dec. 23, 2016 in the Korean Intellectual Property Office, the disclosure of which is incorporated herein by reference.

BACKGROUND

1. Field

Embodiments of the present disclosure relate to a washing machine, and more particularly, to a washing machine including a plurality of washing apparatuses.

2. Description of the Related Art

In general, a washing machine is an apparatus used to wash laundry by rotating a cylindrical drum in which the laundry is contained. Washing machines are classified into washing machines in which a drum is approximately horizontally disposed and laundry is washed while being lifted along an inner wall and dropped during rotation of the drum about a horizontal axis and washing machines in which a drum provided with a pulsator is approximately vertically disposed and laundry is washed by using water streams generated by the pulsator while the drum rotates about a vertical axis.

The washing machines in which the drum is horizontally disposed are referred to as front-loading washing machines since a laundry loading port is formed at a front surface of the washing machines. The washing machines in which the drum is vertically disposed are referred to as top-loading washing machines since a laundry loading port is formed at an upper surface of the washing machines.

Meanwhile, since a conventional washing machine includes one washing apparatus, a user needs to operate the washing machine at least twice in order to separately wash laundry. Thus, even a relatively small amount of laundry takes a long time to be washed.

SUMMARY

Therefore, it is an aspect of the present disclosure to provide a washing machine including a plurality of washing apparatuses.

It is another aspect of the present disclosure to provide a washing machine capable of reducing manufacturing costs.

It is another aspect of the present disclosure to provide a washing machine that prevents siphonage among a plurality of tubs by using a relatively simple structure.

Additional aspects of the disclosure will be set forth in part in the description which follows and, in part, will be obvious from the description, or may be learned by practice of the disclosure.

In accordance with one aspect of the present disclosure, a washing machine includes a first housing; a second housing disposed on the first housing; a first tub included the first housing and having a first opening formed at a front surface thereof; a second tub included the second housing and having a second opening formed at an upper surface thereof; a drain path to drain wash water from the first tub and wash water from the second tub and having at least one portion located at a position higher than a maximum water storage height of the second tub; and a connector coupled to the first housing and disposed at one portion of the drain path where the wash water of the first tub and the wash water of the second tub are joined.

The drain path may include a first drain path through which the wash water from the first tub flows to the connector; a second drain path through which the wash water from the second tub flows to the connector; and a third drain path through which wash water introduced into the connector through the first drain path and the second drain path flows out from the connector.

At least one portion of the third drain path may be located at a position higher than the maximum water storage height of the second tub.

The connector may include a first inlet pipe to form the second drain path; and a first check valve detachable from or attachable to the first inlet pipe and configured to prevent a backflow of the wash water from the second tub in a direction opposite to a drain direction.

The first check valve may include a sealing protrusion which protrudes from a surface in contact with the first inlet pipe.

The washing machine may further include a drain bracket disposed in the first housing, coupled to the connector, and having an insertion pipe inserted into the first check valve.

The connector may include a second check valve disposed at the first drain path and configured to prevent a backflow of the wash water from the first tub in a direction opposite to the drain direction.

The connector further comprises a second inlet pipe to form the first drain path and The second check valve may be detachable from or attachable to the second inlet pipe of the connector.

At least one of the first check valve and the second check valve may be formed of an elastic material.

At least one portion of the second drain path may be located at a position higher than the maximum water storage height of the second tub.

The connector may include a guide rib disposed at a portion thereof where the first drain path and the second drain path are joined and configured to guide the wash water introduced into the connector through the first drain path to the third drain path to prevent a backflow of the wash water introduced into the connector through the first drain path into the first tub.

The connector may further include a first check valve disposed at the second drain path and configured to prevent a backflow of the wash water from the second tub in a direction opposite to the drain direction.

The connector may further include a second check valve formed at the third drain path and configured to prevent a backflow of the wash water from the first tub in a direction opposite to the drain direction.

At least one portion of the first drain path may be located at a position higher than a maximum water storage height of the first tub.

The connector may be coupled to an outer portion of the first housing at a position higher than a maximum water storage height of the first tub.

In accordance with another aspect of the present disclosure, a washing machine includes a first housing; a second housing disposed on the first housing; a first tub included in the first housing; a second tub included in the second housing; a first drain path through which wash water from the first tub flows; a second drain path through which wash water from the second tub flows; a connector disposed at a portion where the first drain path and the second drain path are joined; and a third drain path through which the wash water introduced into the connector through the first drain path and the second drain path flows out, wherein at least one portion of the third drain path is located at a position higher than a maximum water storage height of the second tub.

The connector may includes a first inlet pipe forming the second drain path; a second inlet pipe forming the first drain path; a first check valve detachably coupled to the first inlet pipe and configured to prevent a backflow of wash water in a direction opposite to a drain direction; and a second check valve detachably coupled to the second inlet pipe and configured to prevent a backflow of wash water in a direction opposite to a drain direction.

The first check valve may comprise a sealing protrusion which protrudes from a surface in contact with the first inlet pipe.

In accordance with still another aspect of the present disclosure, a washing machine includes a first housing; a second housing disposed on the first housing; a first tub included in the first housing; a second tub included in the second housing; a first drain path through which wash water from the first tub flows; a second drain path through which wash water from the second tub flows; a connector disposed at a portion where the first drain path and the second drain path are joined; and a third drain path through which the wash water introduced into the connector through the first drain path and the second drain path flows out, wherein at least one portion of the second drain path is located at a position higher than a maximum water storage height of the second tub.

The connector may includes a guide rib disposed at a portion thereof where the first drain path and the second drain path are joined and configured to guide the wash water introduced into the connector through the first drain path to the third drain path to prevent a backflow of the wash water introduced into the connector through the first drain path into the first tub; and a first check valve disposed at the second drain path and configured to prevent a backflow of the wash water from the second tub in a direction opposite to a drain direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
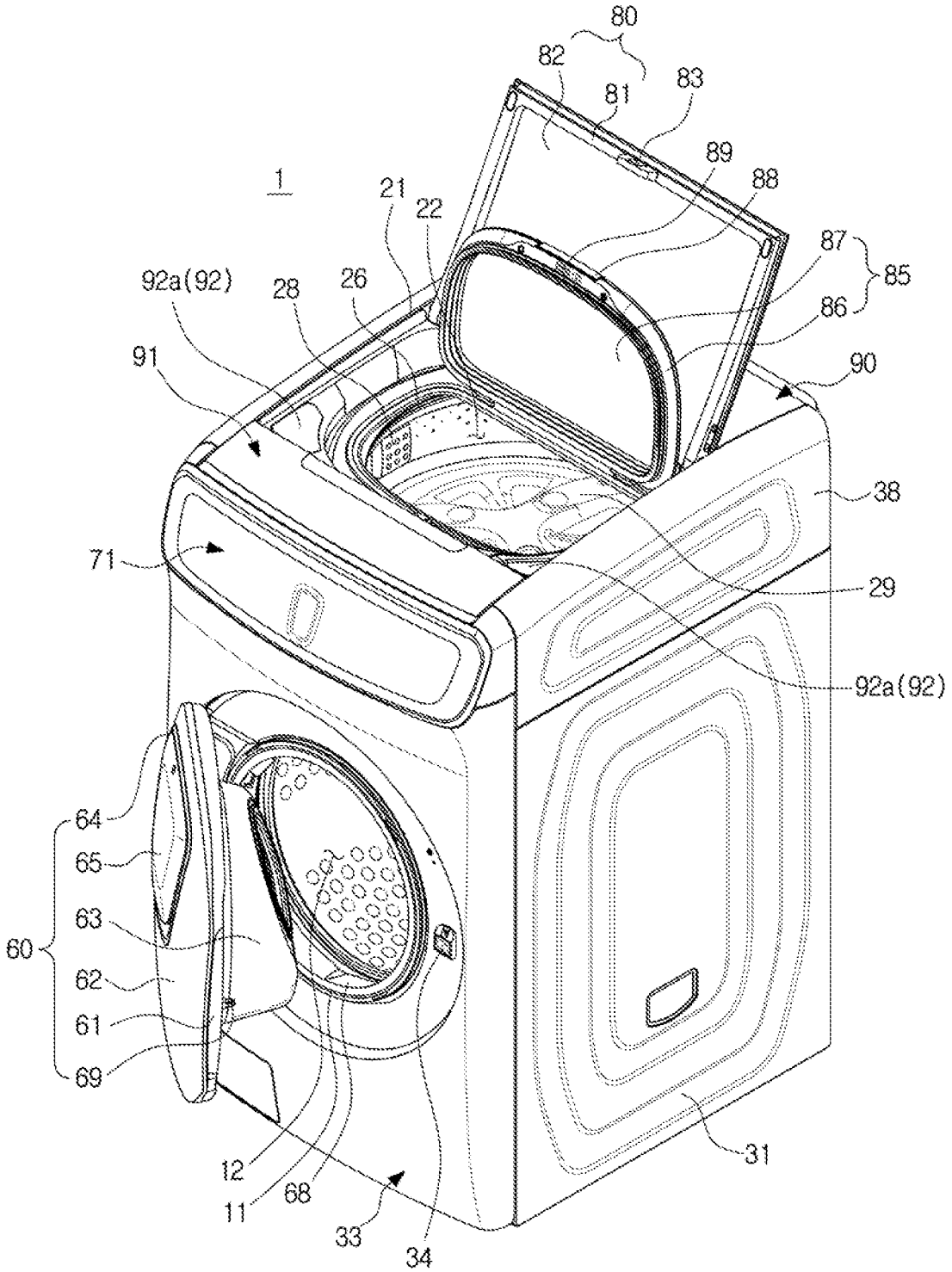
FIG. 1 is a perspective view illustrating a washing machine according to an embodiment.

Reference will now be made in detail to the embodiments of the present disclosure, examples of which are illustrated in the accompanying drawings. The embodiments described in the specification and shown in the drawings are only illustrative and are not intended to represent all aspects of the invention, such that various modifications may be made without departing from the spirit of the invention.

In the drawings, like reference numerals denote like elements or components having substantially same functions.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having", etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

Meanwhile, as used herein, the terms "front", "rear", "up", "down", "front end", "lower end", and the like are defined based on the drawings and the shape and position of each element are not limited by these terms.

Hereinafter, embodiments of the present disclosure will be described in detail with reference to the accompanying drawings.

Figure 2:
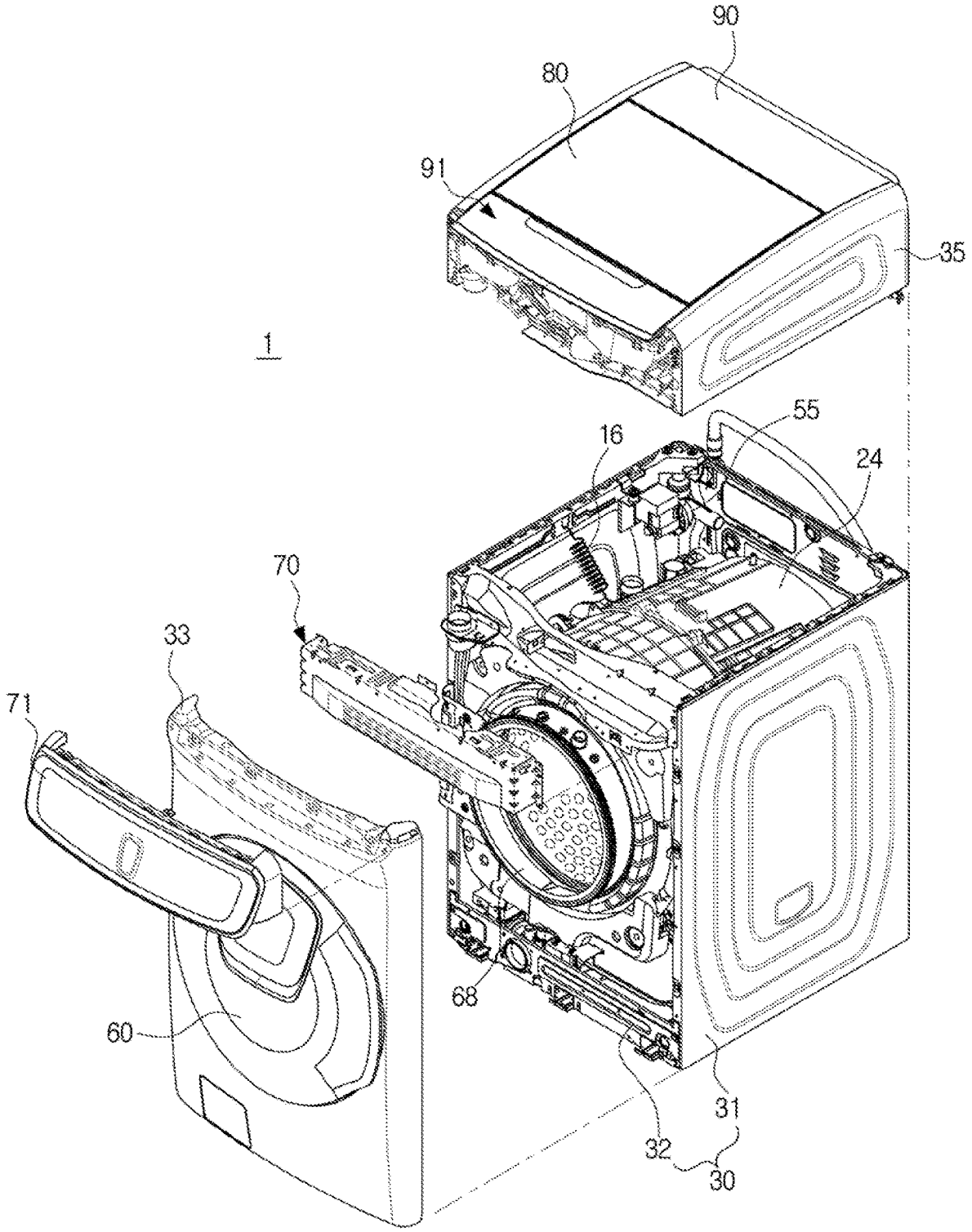
FIG. 2 is an exploded perspective view of the washing machine of FIG. 1.
Figure 3:
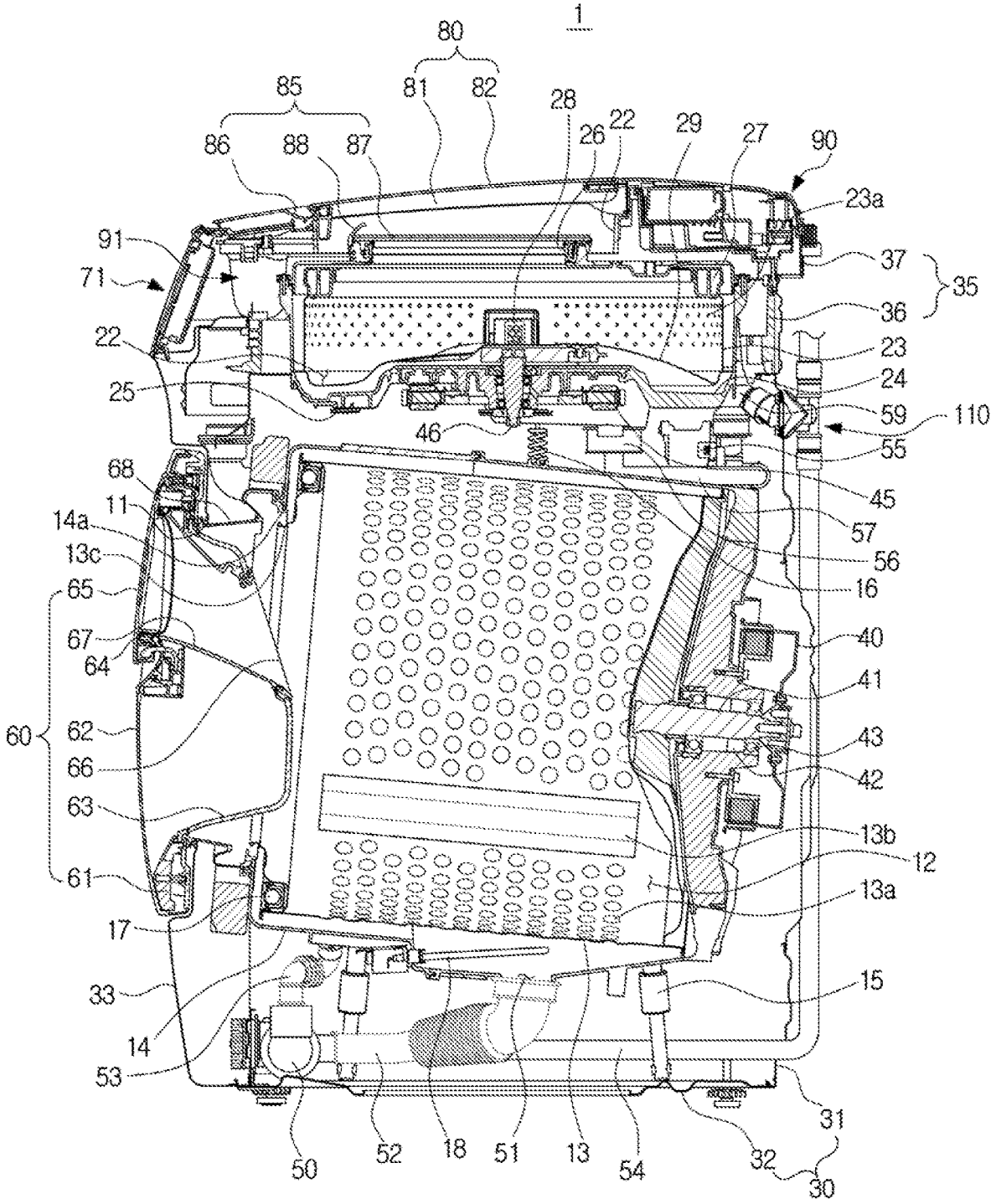
FIG. 3 is a cross-sectional view of the washing machine illustrated in FIG. 1.

FIG. 1 is a perspective view illustrating a washing machine 1 according to an embodiment. FIG. 2 is an exploded perspective view of the washing machine 1 of FIG. 1. FIG. 3 is a cross-sectional view of the washing machine 1 illustrated in FIG. 1.

As shown in FIGS. 1 and 2, the washing machine 1 may include a front-loading first washing apparatus having a first laundry loading port 11 formed at a front portion and a top-loading second washing apparatus having a second laundry loading port 21 formed at a top portion.

The washing machine 1 may include a first drum 13 having a first washing space 12 therein, and a first tub 14 that accommodates the first drum 13 and retains wash water or rinse water used in a washing cycle or rinsing cycle. The first drum 13 and the first tub 14 may have a cylindrical shape with at least a portion of one surface being open which faces forward. The first tub 14 may have a first opening 14*a* formed to face approximately forward.

The washing machine 1 may include a first housing 30 that covers the first drum 13 and the first tub 14. Specifically, the first housing 30 may include a side frame 31 defining side and rear appearances and a bottom frame 32 defining a bottom surface.

The washing machine 1 may further include a damper 15 and a spring 16 to support the first tub 14 with respect to the first housing 30. The damper 15 may support the first tub 14 under the first tub 14 by connecting an outer surface of the first tub 14 with the bottom frame 32. The spring 16 may support the first tub 14 on an upper portion of the first tub 14 by connecting the outer surface of the first tub 14 with an upper end of the side frame 31. The damper 15 and the spring 16 may relieve vibration, noise, and impact caused by movement of the first tub 14.

Installation positions of the damper 15 and the spring 16 are not limited to the upper end of the side frame 31 and the bottom frame 32. If required, the first tub 14 may be supported thereby by connecting one surface of the first tub 14 with one portion of the first housing 30.

The washing machine 1 may include a first drive motor 40 disposed behind a rear plate of the first tub 14 and configured to rotate the first drum 13. A first drive shaft 41 may be connected to the rear plate of the first drum 13 to transmit power of the first drive motor 40 thereto.

A plurality of first through holes 13*a* may be formed through a peripheral wall of the first drum 13 to allow a flow of wash water therethrough. A plurality of lifters 13*b* may be installed on an inner surface of the peripheral wall of the first drum 13 to allow tumbling of laundry during rotation of the first drum 13. A first balancer 17 may be provided at a front end of the first drum 13 for stable rotation of the first drum 13 during high-speed rotation.

The first drive shaft 41 may be disposed between the first drum 13 and the first drive motor 40. One end of the first drive shaft 41 may be connected to the rear plate of the first drum 13 and the other end of the first drive shaft 41 may extend outwardly from a rear wall of the first tub 14. When the first drive motor 40 drives the first drive shaft 41, the first drum 13 connected to the first drive shaft 41 may rotate about the first drive shaft 41.

A bearing housing 42 may be disposed at the rear wall of the first tub 14 to allow rotation of the first drive shaft 41. The bearing housing 42 may be formed of an aluminum alloy and inserted into the rear wall of the first tub 14 during injection molding of the first tub 14. Bearings 43 may be provided between the bearing housing 42 and the first drive shaft 41 for smooth rotation of the first drive shaft 41.

The washing machine 1 may have a function of washing the laundry with hot water. In order to obtain hot water, a heater 18 that heats wash water or rinse water contained in the first tub 14 may be provided at the bottom of the first tub 14.

The washing machine 1 may include a first drain pump 50 disposed at the bottom of the first tub 14 and configured to drain water contained in the first tub 14 out of the washing machine 1, a first connection hose 52 connecting a first drain hole 51 and the first drain pump 50 to allow water contained in the first tub 14 to flow into the first drain pump 50, a circulation hose 53 connecting the first drain pump 50 and the first tub 14 to circulate water introduced into the first drain pump 50 to the first tub 14, and a first drain hose 54 configured to guide water pumped by the first drain pump 50 to a connector 110.

The washing machine 1 may include a front cover 33 having the first laundry loading port 11 through which laundry is loaded into the first washing space 12. A first door 60 configured to open and close the first laundry loading port 11 may be coupled to the front cover 33.

The first door 60 may be formed so as to correspond to the first laundry loading port 11 and be pivotally rotatable about the front cover 33. The first door 60 may include a first door frame 61, a first door cover 62, and a door glass 63.

The first door frame 61 is formed in an approximately annular shape according to the present embodiment, the shape of the first door 60 may be approximately rectangular. The first door cover 62 and the door glass 63 may be formed of a transparent material such that the inside of the first drum 13 is visible from the outside of the washing machine 1 even when the first door 60 closes the first laundry loading port 11. The door glass 63 may be disposed to protrude from the first door frame 61 toward the inside of the first drum 13. According to this configuration, when the first door 60 is closed, the door glass 63 may be inserted into the first laundry loading port 11.

The first door 60 may include a first hinge coupling portion formed at one side of the first door frame 61 to be pivotally rotatable with respect to the front cover 33 and the first hinge coupling portion may be coupled to a first hinge disposed to be adjacent to the first laundry loading port 11. A first hook 69 may be provided at the other side of the first door frame 61. The front cover 33 may have a first hook receiving portion 34 corresponding to the first hook 69 such that the first door 60 is maintained in a state of closing the first laundry loading port 11.

The first door 60 may further include an auxiliary laundry loading port 64 and an auxiliary door 65 configured to open and close the auxiliary laundry loading port 64 such that laundry is loaded into the first washing space 12 even when the first door 60 is closed. The auxiliary door 65 may be rotatably mounted to the first door cover 62.

In order to load laundry into the washing machine 1 through the auxiliary laundry loading port 64 of the first door 60, the laundry should pass through the door glass 63. To this end, the door glass 63 may have a glass through hole 66. Alternatively, the door glass 63 may be recessed at an upper portion such that the door glass 63 is not disposed behind the auxiliary laundry loading port 64.

The first door 60 may have a connection guide part 67 to connect the auxiliary laundry loading port 64 of the first door 60 and the glass through hole 66 of the door glass 63. The connection guide part 67 may be formed in a hollow tubular shape having both open ends.

Specifically, one end of the connection guide part 67 may be connected to the auxiliary laundry loading port 64 and the other end may be connected to the glass through hole 66. According to the present embodiment, the connection guide part 67 may be inclined downward from the front to the rear. That is, the one end of the connection guide part 67 connected to the auxiliary laundry loading port 64 may be positioned higher than the other end thereof. According to this configuration, a user may easily load the laundry into the first drum 13 through the auxiliary laundry loading port 64.

Although the first door 60 includes the auxiliary door 65 according to the present embodiment, the present disclosure is not limited thereto and the first door 60 may be configured without having the auxiliary laundry loading port 64, the auxiliary door 65, and the connection guide part 67.

The washing machine 1 may include a diaphragm 68 disposed between the first laundry loading port 11 of the front cover 33 and the first opening 14*a* of the first tub 14. The diaphragm 68 may form a passage from the first laundry loading port 11 to a third opening 13*c* of the first drum 13 and decrease vibration transmitted to the front cover 33 during rotation of the first drum 13. Also, one portion of the diaphragm 68 may be disposed between the first door 60 and the front cover 33 to prevent leakage of wash water contained in the first tub 14 out of the washing machine 1.

The washing machine 1 may include a second drum 23 having a second washing space 22 and a second tub 24 that accommodates the second drum 23 and retains wash water or rinse water used in a washing cycle or rinsing cycle. The second drum 23 and the second tub 24 may have a cylindrical shape with at least a portion of one surface being open which faces upward. The second tub 24 may have a second opening 26 formed to face approximately upward.

The washing machine 1 may include a second housing 35 that covers the second drum 23 and the second tub 24. Specifically, the second housing 35 may include a lower frame 36 configured to support the second tub 24 and an upper frame 37 having a second laundry loading port 21 through which laundry is loaded into the second washing space 22 and seated on the lower frame 36.

The side cover 38 simplifies side surfaces of the second housing 35 by covering left and right sides of the lower frame 36 and the upper frame 37 by using one member. When the lower frame 36 and the upper frame 37 are disassembled by vibration or the like, the side cover 38 may prevent dislocation thereof, thereby inhibiting the user from being injured thereby.

The washing machine 1 may include a second door 80 disposed at the second housing 35 and configured to open and close the second laundry loading port 21. The second door 80 may be formed so as to correspond to the second laundry loading port 21 and be pivotally rotatable with respect to the upper frame 37.

The second door 80 may include a second door frame 81 and a second door cover 82. The second door cover 82 may be formed of a transparent material such that the inside of the second tub 24 and the second drum 23 is visible from the outside of the washing machine 1 even when the second door 80 closes the second laundry loading port 21.

Second hinges (not shown) may be provided at the left and right sides of the second door frame 81 to allow the second door 80 to pivotally rotate about the upper frame 37. The second hinge may be coupled to a second hinge coupling portion (not shown) formed around the second laundry loading port 21. A latch receiving part 83 may be provided at the front end of the second door frame 81 and a latch unit may be provided at the upper frame 37 to correspond to the latch receiving part 83 of the second door frame 81. According to this configuration, the second door 80 of the washing machine 1 according to the present embodiment may be maintained in a state of closing the second laundry loading port 21.

The second drum 23 may be provided in a cylindrical shape having an open top surface and rotatable within the second tub 23. A plurality of through holes 23*a* may be formed through a side surface and/or a bottom surface of the second drum 23 to allow a flow of wash water therethrough. A second balancer 27 may be mounted at an upper portion of the second drum 23 for stable rotation of the second drum 23 during high-speed rotation. A filter 28 may be attached to the inner surface of the second drum 23 so as to remove foreign substances during washing.

A curved portion 29 to generate water streams may be formed on the bottom surface of the second drum 23. Although not shown in the drawings, the washing machine 1 may further include a pulsator disposed in the second drum 23 to generate water streams.

The second tub 24 may be provided in a cylindrical shape and supported by the lower frame 36 via a suspension 25. Specifically, the second tub 24 may be supported in the form of being hung by four suspensions 25. The second drum 23 may have a second opening 26 formed at a top surface thereof to correspond to the second laundry loading port 21 and a third door 85 may be coupled thereto to open and close the second opening 26. The third door 85 may seal the second washing space 22 to prevent leakage of wet steam while the second washing apparatus performs a washing cycle using hot wash water.

The third door 85 may include a third door frame 86 and a third door cover 87. The third door cover 87 may be formed of a transparent material such that the inside of the second drum 23 is visible from the outside of the second tub 24 even when the third door 85 closes the second opening 26.

A third hinge (not shown) may be provided around the second opening 26 such that the third door 85 is pivotally rotatable with the second tub 24 and coupled to a third hinge coupling portion (not shown) formed at one side of the third door frame 86. A handle 88 to open and close the third door 85 may be provided at the other side of the third door frame 86 and a second hook 89 may be provided at the handle 88. A second hook receiving part (not shown) may be disposed at the second tub 24 to correspond to the second hook 89. Accordingly, the third door 85 may be maintained in a state of closing the second opening 26. In addition, when the handle 88 is pulled, the second hook 89 is disengaged from the second hook receiving part so that the third door 85 may completely open the second washing space 22.

The washing machine 1 may include a second drive motor 45 disposed under a bottom plate of the second tub 24 and configured to rotate the second drum 23. A second drive shaft 46 may be connected to the bottom plate of the second drum 23 to transmit power of the second drive motor 45 thereto. One end of the second drive shaft 46 may be connected to the bottom plate of the second drum 23 and the other end of the second drive shaft 46 may extend outward from a bottom wall of the second tub 24. When the second drive motor 45 drives the second drive shaft 46, the second drum 23 connected to the second drive shaft 46 may rotate about the second drive shaft 46.

Although not shown in the drawings, when the pulsator is disposed on the bottom surface of the second drum 23, the washing machine 1 may further include a power switching device to transmit power generated by the second drive motor 45 simultaneously or selectively to the second drum 23 and the pulsator.

The washing machine 1 may include a second drain pump 55 disposed at the bottom of the second tub 24 and configured to drain water contained in the second tub 24 out of the washing machine 1 and a second drain hose 59 configured to guide the water pumped by the second drain pump 55 to the connector 110. The second drain pump 55 may be mounted to an upper portion of the first housing 30.

A second drain hole 56 to drain water from the second tub 24 may be disposed at the bottom of the second tub 24 and the second drain hole 56 may be connected to the second drain pump 55 via a second connection hose 57 to allow water contained in the second tub 24 into the second drain pump 55.

The washing machine 1 may include a water supply device 90 to supply wash water into the first tub 14 and the second tub 24. The water supply device 90 may be disposed at the second housing 35. Specifically, the water supply device 90 may be disposed at the upper frame 37, preferably, behind the second laundry loading port 21.

The washing machine 1 may further include a first detergent feed device 91 to feed a detergent into the first tub 14. The first detergent feed device 91 may be disposed at the second housing 35. Specifically, the first detergent feed device 91 may be disposed at the upper frame 37, preferably in front of the second laundry loading port 21.

The washing machine 1 may include a second detergent feed device 92 disposed at the second housing 35 and configured to retain a fabric softener and/or a bleach to be fed into the second washing space 22. The second detergent feed device 92 may be disposed at the upper frame 37 and include a detergent case 92*a* having an opening that faces approximately upward. The second detergent feed device 92 may be disposed at left and right ends of the front of the second opening 26 respectively. The second detergent feed device 92 may be provided to allow the user to access thereto by opening the second door 80.

The washing machine 1 may include a fixing bracket 70 that couples the first housing 30 and the second housing 35 so as not to be separated from each other.

The washing machine 1 may include a control panel 71 disposed on the front cover 33 and configured to operate the washing machine 1. The control panel may include an input unit (not shown) to receive an operation command of the washing machine 1 from the user and a display unit (not shown) to display operation information of the washing machine 1.

Figure 4:
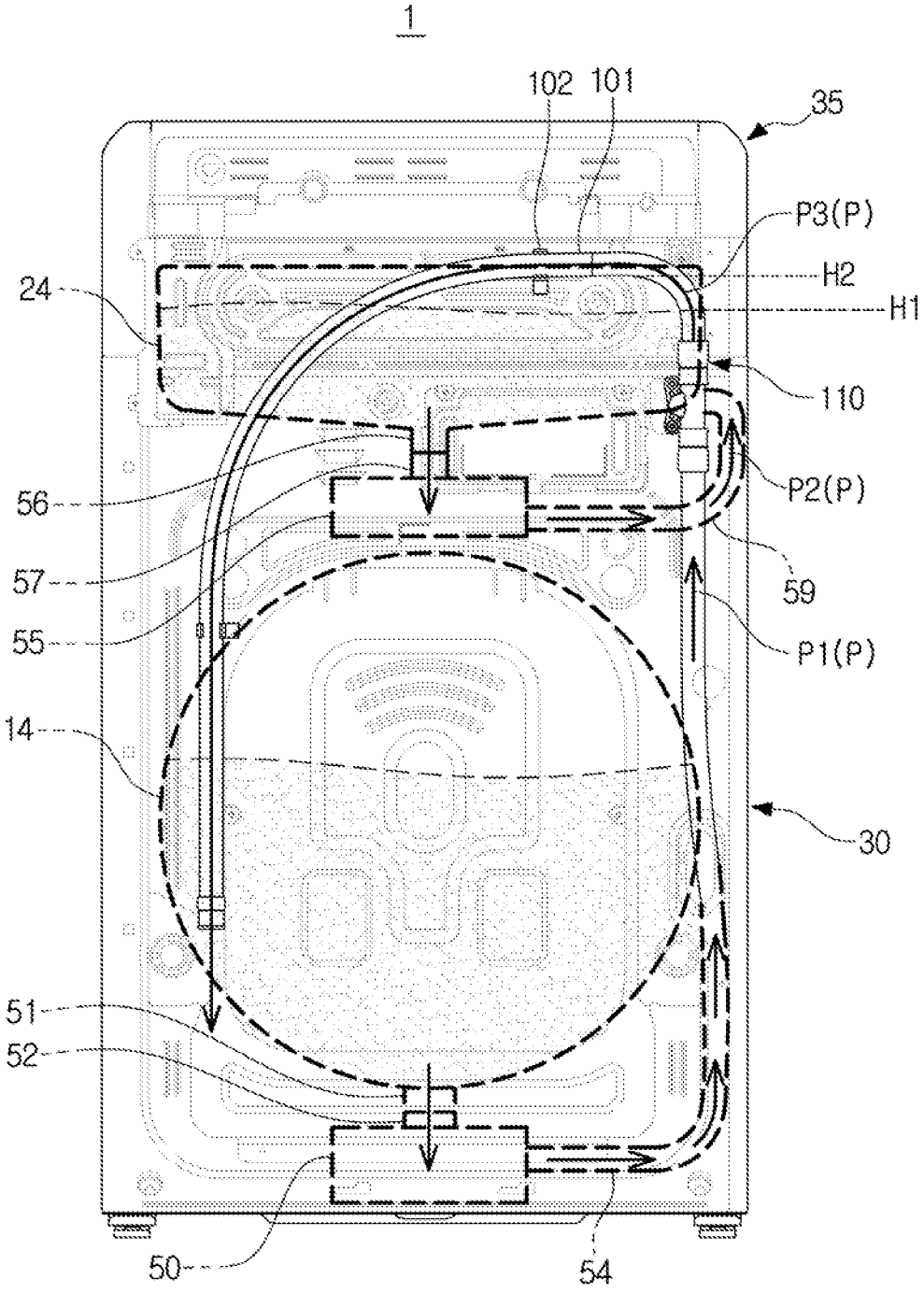
FIG. 4 is a rear view of the washing machine of FIG. 1 illustrating a drain path.
Figure 5:
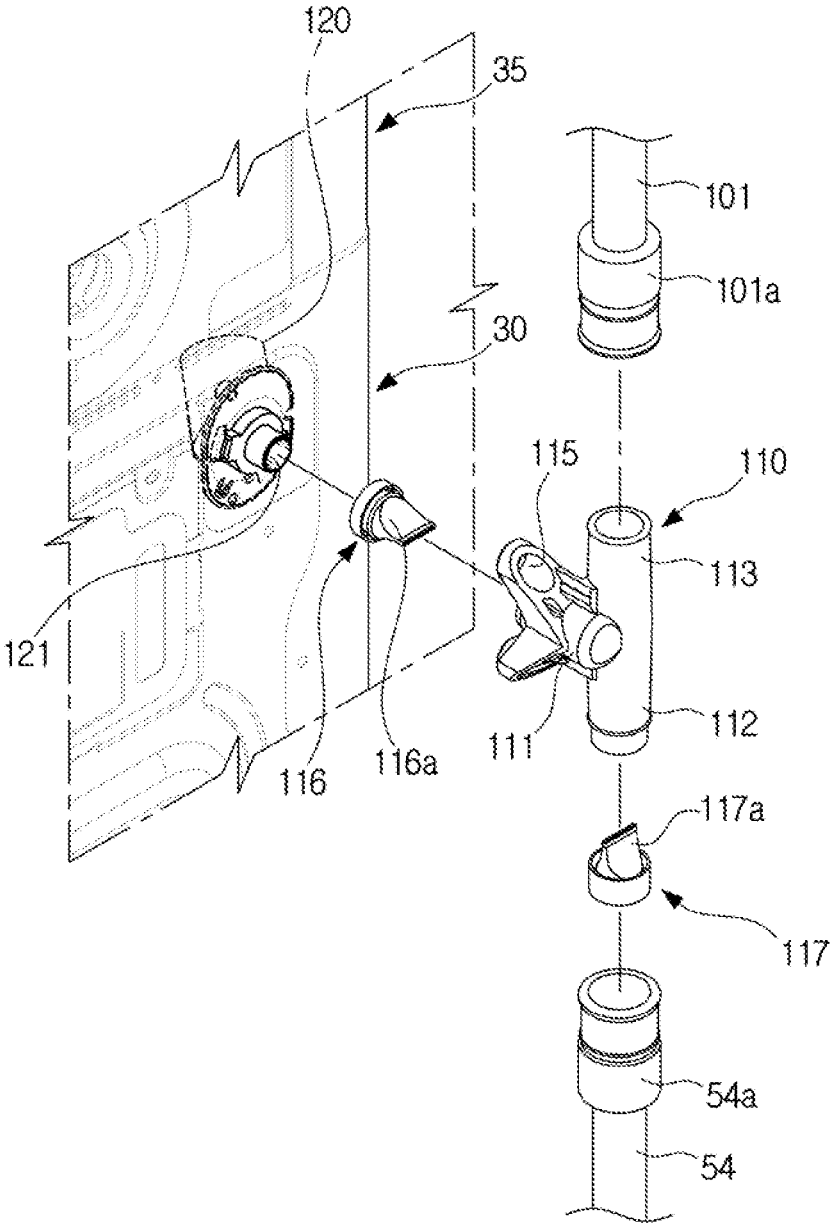
FIG. 5 is an exploded view of a connector and a drain bracket shown in FIG. 4.
Figure 6:
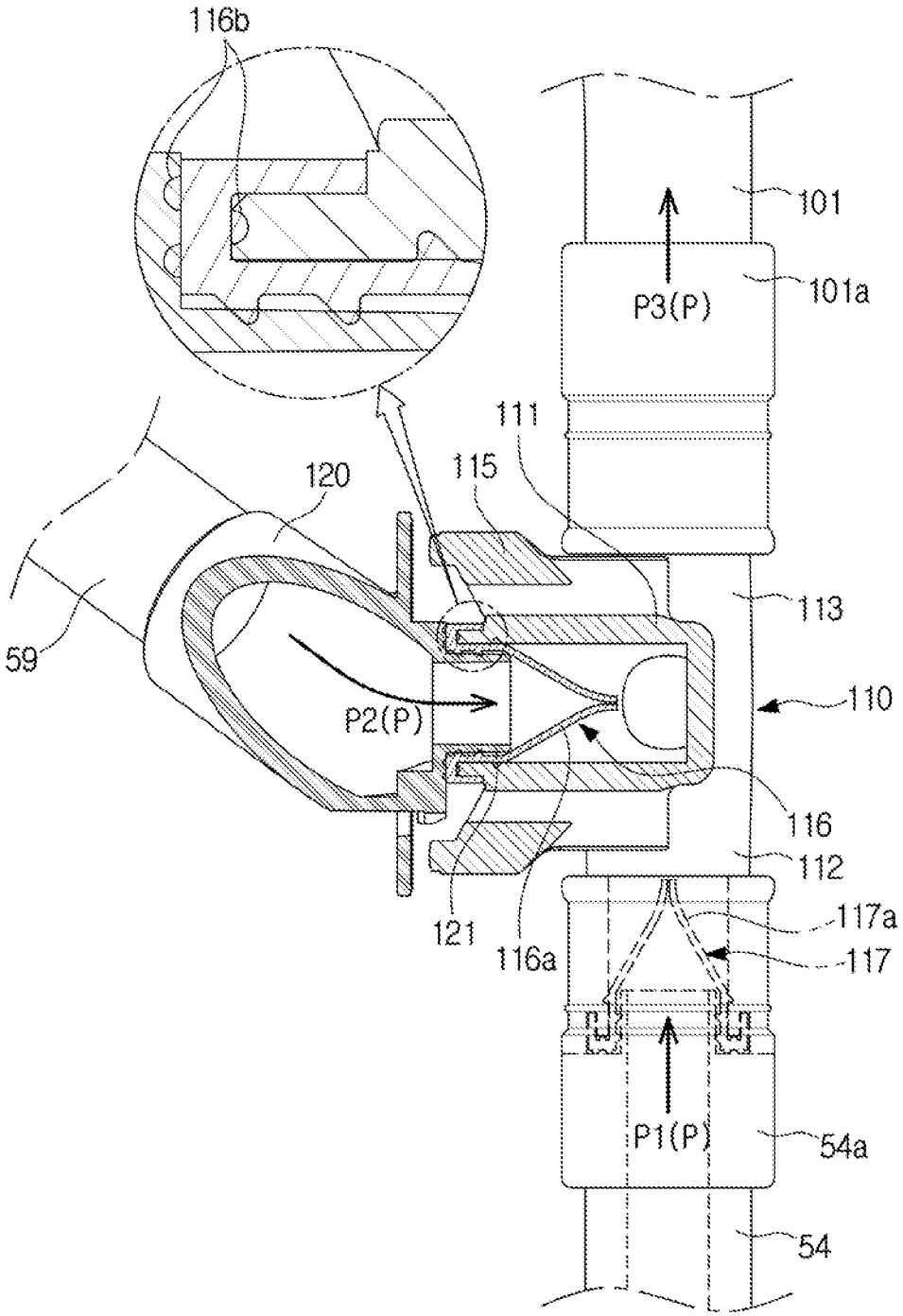
FIG. 6 is a cross-sectional view illustrating a coupled state of the connector and the drain bracket shown in FIG. 4.

FIG. 4 is a rear view of the washing machine 1 of FIG. 1 illustrating a drain path P. FIG. 5 is an exploded view of a connector 110 and a drain bracket 120 shown in FIG. 4. FIG. 6 is a cross-sectional view illustrating a coupled state of the connector 110 and the drain bracket 120 shown in FIG. 4.

Referring to FIGS. 4 to 6, a drain path P of wash water from the first tub 14 and the second tub 24 of the washing machine 1 according to an embodiment will be described. Hereinafter, the drain path P is defined to include a flow path through which wash water of the first tub 14 flows out of the washing machine 1 and a flow path through which wash water of the second tub 24 flows out of the washing machine 1.

The drain path P of the washing machine 1 according to the present embodiment may include a first drain path P1 through which wash water of the first tub 14 flows to the connector 110, a second drain path P2 through which wash water of the second tub 24 flows to the connector 110, and a third drain path P3 through which wash water introduced into the connector 110 out of the washing machine 1. In this regard, at least one portion of the drain path P may be located at a higher position than a maximum water storage height H1 of the second tub 24.

Specifically, the first drain path P1 is a part of the flow path for draining wash water of the first tub 14 and may be defined by the first drain hole 51, the first connection hose 52, the first drain pump 50, the first drain hose 54, and a second inlet pipe 112 of the connector 110. Wash water of the first tub 14 may flow to the connector 110 via the first drain path P1.

The second drain path P2 is a part of the flow path for draining wash water of the second tub 24 and may be defined by the second drain hole 56, the second connection hose 57, the second drain pump 55, the second drain hose 59, and a first inlet pipe 111 of the connector 110. Wash water of the second tub 24 may flow to the connector 110 through the second drain path P2.

The third drain path P3 is a flow path for draining both wash water of the first tub 14 and wash water of the second tub 24 and may be defined by an outlet 113 of the connector 110 and a third drain hose 101. Wash water introduced into the connector 110 through the first drain path P1 and the second drain path P2 may flow out of the washing machine 1 through the third drain path P3.

In the washing machine 1 according to the present embodiment, at least one portion of the third drain path P3 may be located at a position H2 higher than the maximum water storage height H1 of the second tub 24. Specifically, at least one portion of the third drain hose 101 constituting the third drain path P3 may be fixed to the position H2 higher than the maximum water storage height H1 of the second tub 24. To this end, the washing machine 1 may include a fixing member 102 to fix the one portion of the third drain hose 101. The fixing member 102 may fix the third drain hose 101 to the second housing 35.

According to this configuration, the washing machine 1 according to an embodiment may prevent wash water supplied into the second tub 24 from being drained through the third drain path P3 while water is supplied into the second tub 24.

That is, since a separate electronic control valve is not disposed at the second drain path P2 in the washing machine 1 according to an embodiment, wash water is filled in the second drain hole 56, the second connection hose 57, the second drain pump 55, the second drain hose 59, the connector 110, and the third drain hose 101 at the same height as that of the second tub 24 while water is supplied into the second tub 24. In this case, if the third drain hose 101 is located at a lower position than the maximum water storage height H1 of the second tub 24, wash water filled in the third drain hose 101 starts to be drained out of the washing machine 1. Accordingly, all of the wash water of the second tub 24 may be drained out of the washing machine 1 by siphonage.

Thus, at least one portion of the third drain path P3 may be disposed at a position H2 higher than the maximum water storage height H1 of the second tub 24 in the washing machine 1 according to the present embodiment. In this case, wash water does not fill the entire third drain path P3 of the washing machine 1, so that the loss of wash water of the second tub 24 caused by siphonage may be prevented even when water is supplied into the second tub 24.

The washing machine 1 according to an embodiment may include the connector 110 that connects the first drain path P1, the second drain path P2, and the third drain path P3. The connector 110 may be coupled to the first housing 30, particularly, to the side frame 31. The connector 110 may be provided at the drain path P. The connector 110 may be located at one portion of the drain path P where wash water of the first tub 14 and wash water of the second tub 24 are joined. The connector 110 may guide wash water flowing in the first drain path P1 and wash water flowing in the second drain path P2 to be joined and flow into the third drain path P3.

The connector 110 may include the first inlet pipe 111 forming the second drain path P2, the second inlet pipe 112 forming the first drain path P1, and an outlet 113 forming the third drain path P3.

The first inlet pipe 111 may be coupled to the first housing 30 together with the drain bracket 120, which will be described later. The first inlet pipe 111 may be coupled to the first housing 30 via a fixing part 115 provided at one portion of the outer circumferential surface. The fixing part 115 may be coupled to the first housing 30 by screw coupling. Accordingly, the connector 110 may be easily separated from the first housing 30 and easily maintained and repaired.

The second inlet pipe 112 may be connected to the first drain hose 54. Specifically, the second inlet pipe 112 may be connected to the first drain hose 54 by the first connection member 54*a*.

The outlet 113 may be connected to the third drain hose 101. Specifically, the outlet 113 may be connected to the third drain hose 101 by the second connection member 101*a*. The third drain hose 101 may extend such that wash water is drained from an upper portion of the washing machine 1. Alternatively, the third drain hose 101 may also extend such that wash water is drained from a lower portion of the washing machine 1.

The connector 110 may include a first check valve 116 detachably coupled to the first inlet pipe 111 and configured to prevent a backflow of wash water in a direction opposite to a drain direction. The first check valve 116 may be formed of an elastic material. Specifically, the first check valve 116 may be a duckbill valve formed of rubber or a synthetic elastomer.

The first check valve 116 may allow wash water to flow in a predetermined direction in the second drain path P2 without using a separate control device. That is, a first opening/closing unit 116*a* of the first check valve 116 is opened by a pressure of wash water to open the second drain path P2 in the case where wash water flows in the drain direction in the second tub 24 and returns to an original shape thereof by a force of restoration to close the second drain path P2 in the case where wash water flows in the direction opposite to the drain direction.

The first check valve 116 may include a first sealing protrusion 116*b* protruding from a surface in contact with the first inlet pipe 111. The first sealing protrusion 116*b* may seal a gap between the first inlet pipe 111 and the first check valve 116 so that leakage of water from a joined portion of the first inlet pipe 111 and the first check valve 116.

The first sealing protrusion 116*b* of the first check valve 116 may also protrude from a surface in contact with the drain bracket 120. Thus, the first sealing protrusion 116*b* may seal a gap between the first check valve 116 and the drain bracket 120 so that leakage of water may be prevented from a joined portion of the first check valve 116 and the drain bracket 120.

Although the first check valve 116 coupled to the connector 110 has been described above, the position of the first check valve 116 is not limited thereto and the first check valve 116 may also be disposed at the second drain path P2 to prevent a backflow of wash water in the second drain path P2.

The connector 110 may include a second check valve 117 detachably coupled to the second inlet pipe 112 and configured to prevent a backflow of wash water in a direction opposite to the drain direction. However, the position of the second check valve 117 is not limited thereto, and the second check valve 117 may also be disposed at the first drain path P1 to prevent a backflow of wash water in the first drain path P1. The second check valve 117 may be configured in the same manner as the first check valve 116. That is, the second check valve 117 may include a second opening/closing unit 117*a* having the same functions as the first opening/closing unit 116*a* of the first check valve 116. In addition, the second check valve 117 may include a second sealing protrusion (not shown) having the same functions as the first sealing protrusion 116*a* of the first check valve 116.

The washing machine 1 may include the drain bracket 120 disposed inside the first housing 30, coupled to the connector 110, and including an insertion pipe 121 inserted into the first check valve 116. One end of the drain bracket 120 provided with the insertion pipe 121 may be connected to the first check valve 116 and the other end of the drain bracket 120 opposite thereto may be connected to the second drain hose 59. The drain bracket 120 may be connected to the connector 110 with the side frame 31 disposed therebetween. The insertion pipe 121 may be disposed to penetrate the first housing 30.

According to this configuration, wash water of the first tub 14 of the washing machine 1 according to the present embodiment may be drained out of the washing machine 1 through the first drain path P1, the connector 110, and the third drain path P3 by power of the first drain pump 50, and wash water of the second tub 24 may be drained out of the washing machine 1 through the second drain path P2, the connector 110, and the third drain path P3 by power of the second drain pump 55. Also, when the third drain hose 101 extends upward in the washing machine 1, the first check valve 116 may prevent a backflow of wash water remaining in the third drain hose 101 into the second tub 24 and the second check valve 117 may prevent a backflow of wash water remaining in the third drain hose 101 into the first tub 14.

According to this configuration, the connector 110 is directly coupled to the first housing 30, and thus the washing machine 1 appears to have a single drain path P when viewed from the outside of the washing machine 1. Therefore, an integrated appearance may be given although the washing machine 1 includes a plurality of washing apparatuses.

In addition, since the first check valve 116 is disposed at the second drain path P2 in the washing machine 1, a backflow of wash water into the second tub 24 may be prevented by using the simple structure.

Also, since the second check valve 117 is disposed at the first drain path P1 in the washing machine 1, a backflow of wash water into the first tub 14 may be prevented by using the simple structure.

Figure 7:
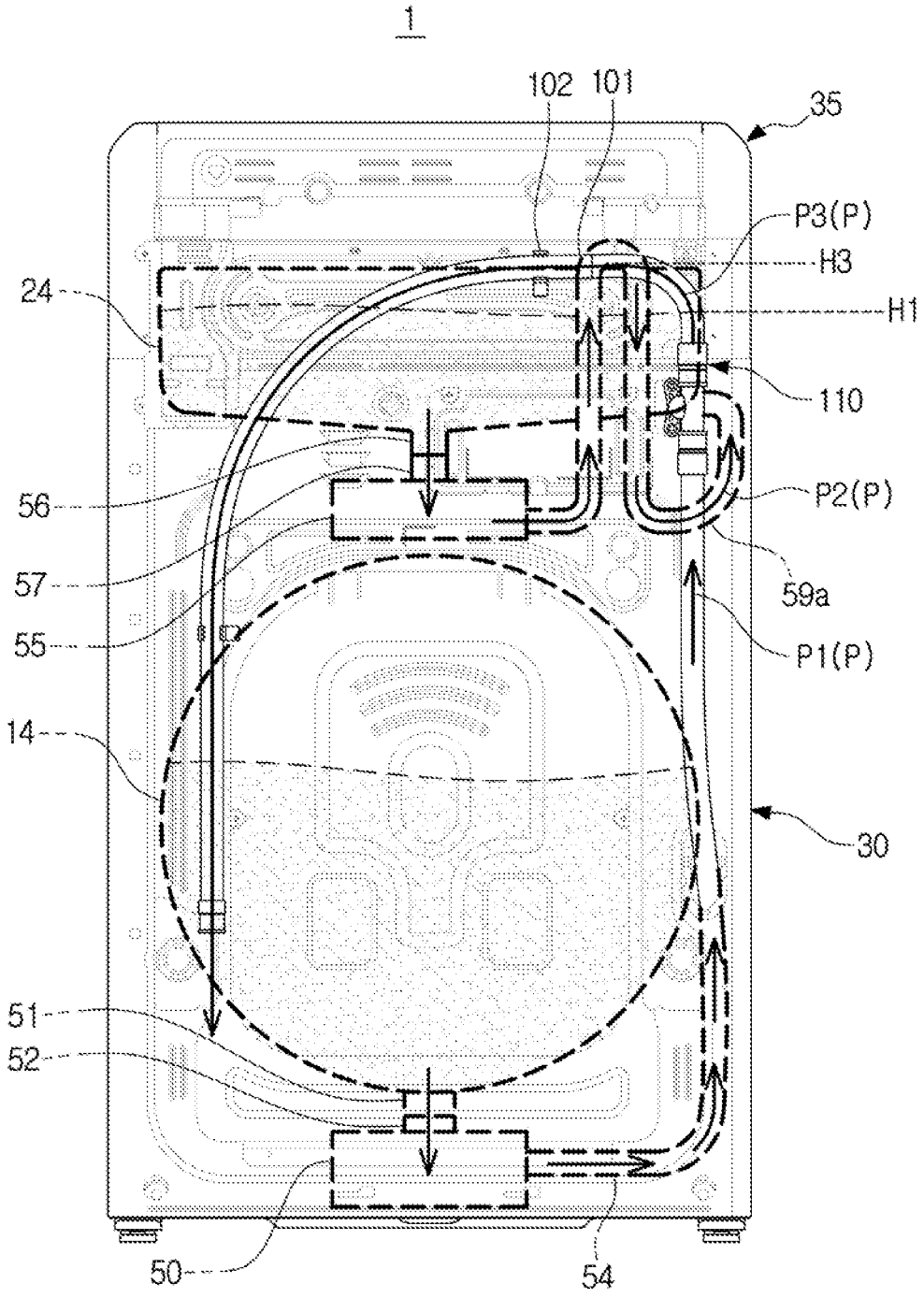
FIG. 7 is a view illustrating another example of the second drain hose of the washing machine illustrated in FIG. 4.

FIG. 7 is a view illustrating another example of the second drain hose 59 of the washing machine 1 illustrated in FIG. 4.

In the washing machine 1 according to an embodiment, at least one portion of a second drain hose 59*a* may be disposed at a position H3 higher than the maximum water storage height H1 of the second tub 24. That is, at least one portion of the second drain path P2 may be located at the position H3 higher than the maximum water storage height H1 of the second tub 24.

According to this configuration, the washing machine 1 may prevent wash water from being drained out of the washing machine 1 through the drain path P while water is supplied into the second tub 24. That is, even when the second tub 24 is filled up to a maximum height, wash water cannot pass through the second drain hose 59*a* and flow into the connector 110. Thus, the washing machine 1 may prevent wash water from being drained out of the washing machine 1 through the third drain path P3 by siphonage.

Figure 8:
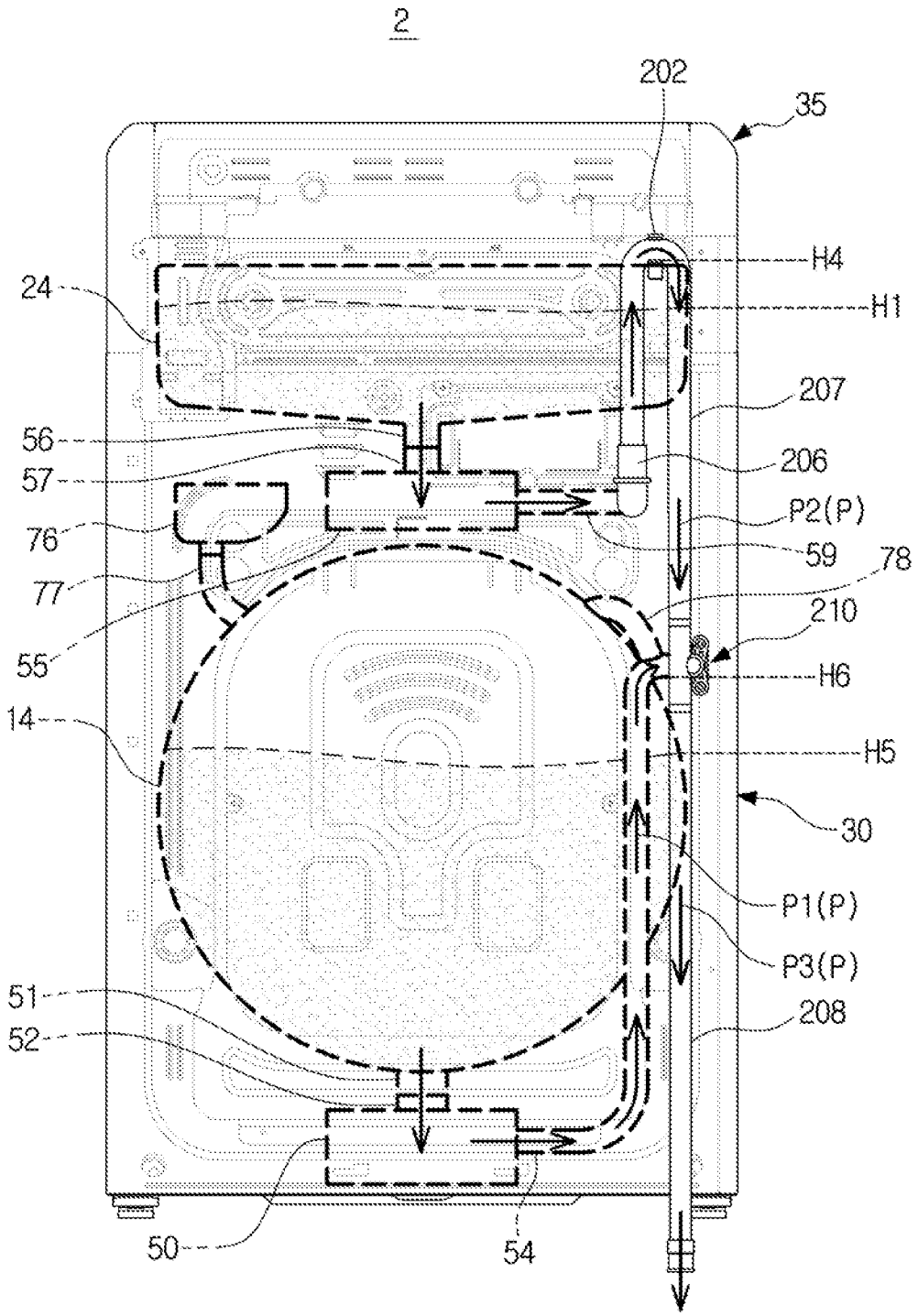
FIG. 8 is a rear view of a drain path of a washing machine according to another embodiment of the present disclosure.
Figure 9:
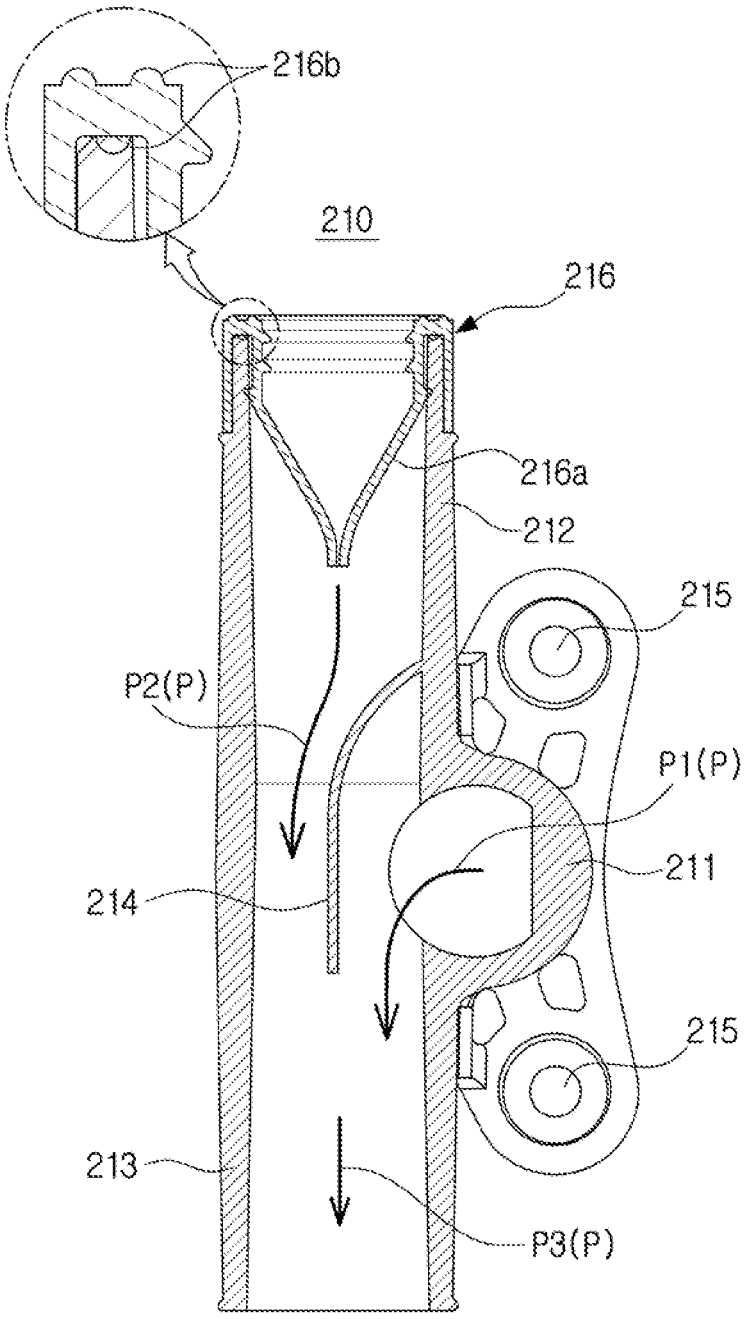
FIG. 9 is a cross-sectional view of a connector illustrated in FIG. 8.

FIG. 8 is a rear view of a drain path P of a washing machine 2 according to another embodiment of the present disclosure. FIG. 9 is a cross-sectional view of a connector 210 illustrated in FIG. 8.

Referring to FIGS. 8 and 9, the washing machine 2 will be described. The same reference numerals are given to the same components as components described above with reference to FIGS. 4 to 6, and descriptions thereof will not be repeated.

The connector 210 of the washing machine 2 may be coupled to the first housing 30, particularly, the first drain hose 54 through which wash water of the first tub 14 is drained. In this case, the connector 210 may be disposed at a position H6 higher than a maximum water storage higher H5 of the first tub 14. That is, the first drain hose 54 may be connected to a first inlet pipe 211 of the connector 210 at the position H6 higher than the maximum water storage higher H5 of the first tub 14.

Also, in this case, at least one portion of the second drain path P2 may be disposed at a position H4 higher than the maximum water storage height H1 of the second tub 24 to prevent the loss of wash water from the second tub 24 by siphonage.

In this case, the second drain path P2 may be defined by the second drain hole 56, the second connection hose 57, the second drain pump 55, the second drain hose 59, an auxiliary pipe 206, an auxiliary hose 207, and a second inlet pipe 212 of the connector 210. That is, the washing machine 2 may include the auxiliary pipe 206 and the auxiliary hose 207 unlike the embodiment illustrated in FIG. 4.

The auxiliary pipe 206 penetrates the first housing 30. One end of the auxiliary pipe 206 may be connected to the second drain hose 59 and the other end may be connected to the auxiliary hose 207.

One end of the auxiliary hose 207 may be connected to the auxiliary pipe 206, and the other end opposite thereto may be connected to the second inlet pipe 212 of the connector 210. Also, at least one portion of the auxiliary hose 207 may be disposed at the position H4 higher than the maximum water storage height H1 of the second tub 24. That is, at least one portion of the auxiliary hose 207 may be fixed to the second housing 35 by a fixing member 202 at the position H4 higher than the maximum water storage height H1 of the second tub 24.

However, the auxiliary pipe 206 may be omitted and thus the second drain hose 59 may extend to the second inlet pipe 212 of the connector 210 such that one portion of the second drain hose 59 is disposed at the position H4 higher than the maximum water storage height H1 of the second tub 24. In this case, one portion of the second drain hose 59 may be fixed to the second housing 35 by a fixing device such as a clamp.

The third drain path P3 may be defined by an outlet 213 of the connector 210 and a third drain hose 208. The third drain hose 208 may extend such that wash water is drained downward from the washing machine 2.

The connector 210 may include the first inlet pipe 211 forming the first drain path P1, the second inlet pipe 212 forming the second drain path P2, and the outlet 213 forming the third drain path P3. The connector 210 may be coupled and fixed to the first housing 30 by a fixing part 215. The fixing part 215 may be coupled to the first housing 30 by screw coupling. The connector 210 may be coupled to an outer portion of the first housing 30 at a position H6 higher than the maximum water storage height H5 of the first tub 14.

The connector 210 may include a guide rib 214 disposed at a position where the first drain path P1 and the second drain path P2 are joined and preventing a backflow of wash water into the first tub 14. The guide rib 214 may protrude from an inner surface of the connector 210 and extend in a drain direction of wash water. The guide rib 214 may partition an inner space of the connector 210.

The washing machine 2 may include a draying apparatus 76 that supplies hot air to dry laundry contained in the first tub 14. The drying apparatus 76 may be connected to the first tub 14 via a drying hose 77.

The washing machine 2 may further include a sub hose 78 to discharge hot air supplied by the drying apparatus 76. The sub hose 78 may be connected to the first drain hose 54 in the first housing 30. That is, hot air contained in the first tub 14 may flow to the first drain hose 54 via the sub hose 78 and then discharged out of the washing machine 2 through the drain path P. In order to efficiently discharge the hot air of the first tub 14 out of the washing machine 2 through the first inlet pipe 211 and the third drain path P3, the first inlet pipe 211 may dispense with the first check valve 116 illustrated in FIGS. 4 to 6.

The connector 210 may include a first check valve 216 disposed at the second drain path P2 and configured to prevent a backflow of wash water in a direction opposite to the drain direction. The first check valve 216 may include a first opening/closing unit 216*a* and the second sealing protrusion 216*b* like the first check valve 116 illustrated in FIG. 4. However, the washing machine 2 may not include the first check valve 216.

The connector 210 may include a second check valve (not shown) disposed at the third drain path P3 and configured to prevent a backflow of wash water in a direction opposite to the drain direction. The second check valve may include a second opening/closing unit (not shown) and second sealing protrusion (not shown) like the first check valve 216. However, the washing machine 2 may not include the second check valve.

According to this configuration, wash water of the first tub 14 of the washing machine 2 according to the present embodiment may be drained out of the washing machine 2 through the first drain path P1, the connector 210, and the third drain path P3 by power of the first drain pump 50, and wash water of the second tub 24 may be drained out of the washing machine 2 through the second drain path P2, the connector 110, and the third drain path P3 by power of the second drain pump 55. Also, since most of wash water of the third drain hose 101 may be drained by gravity, wash water does not remain in the drain path P.

Figure 10:
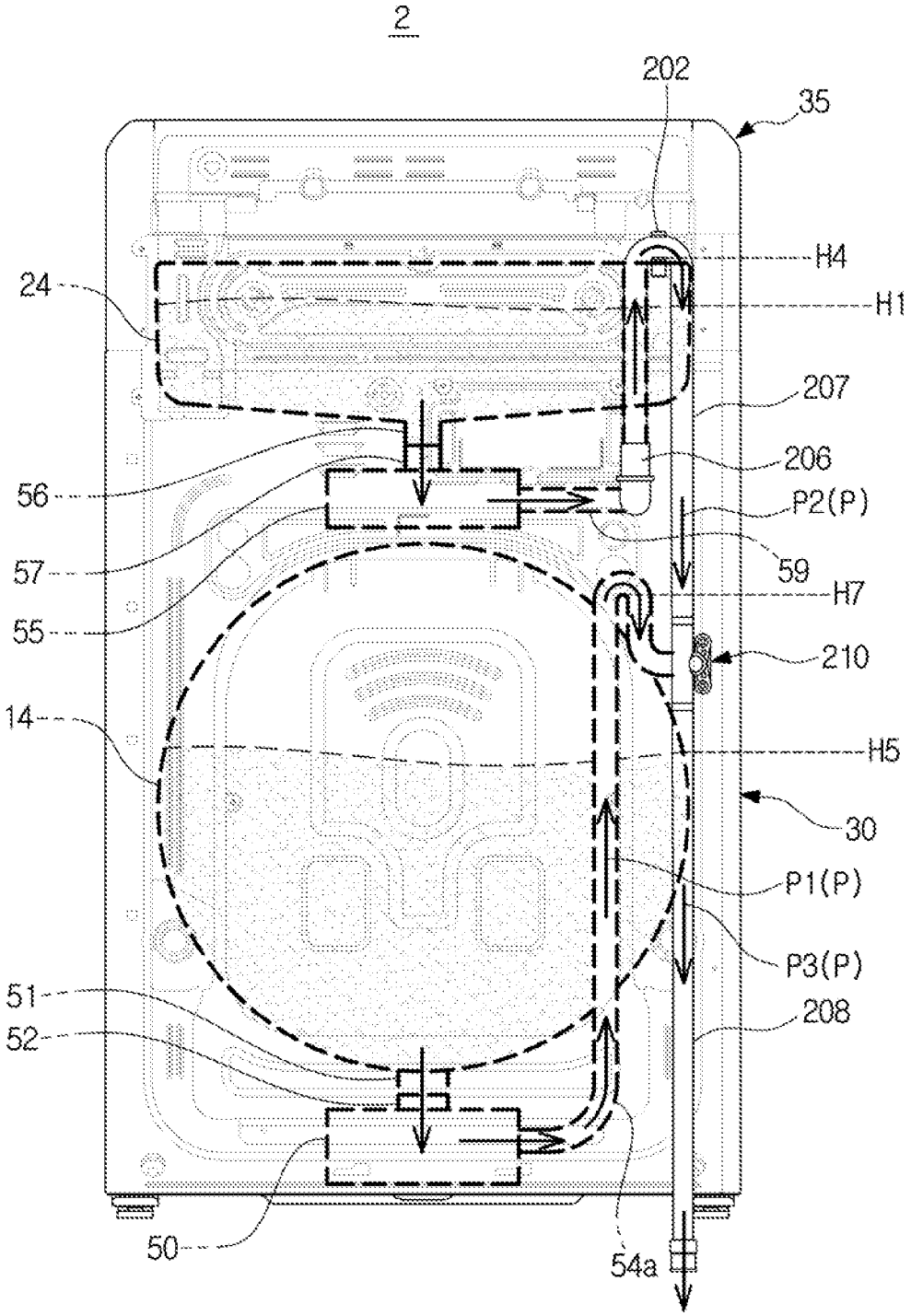
FIG. 10 is a view illustrating another example of the first drain hose of the washing machine illustrated in FIG. 8.

FIG. 10 is a view illustrating another example of the first drain hose 54 of the washing machine 2 illustrated in FIG. 8.

At least one portion of the first drain hose 54*a* of the washing machine 2 according to another embodiment of the present disclosure may be disposed at a position H7 higher than the maximum water storage higher H5 at the first tub 14. That is, at least one portion of the first drain path P1 may be disposed at the position H7 higher than the maximum water storage higher H5 of the first tub 14.

According to this configuration, the washing machine 2 may prevent wash water from being drained out of the washing machine 2 through the drain path P while water is supplied into the first tub 14. That is, even when the first tub 14 is filled up to a maximum height, wash water cannot pass through the first drain hose 54*a* and flow into the connector 210. Thus, the washing machine 2 may prevent wash water from being drained out of the washing machine 2 through the third drain path P3 by siphonage.

Figure 11:
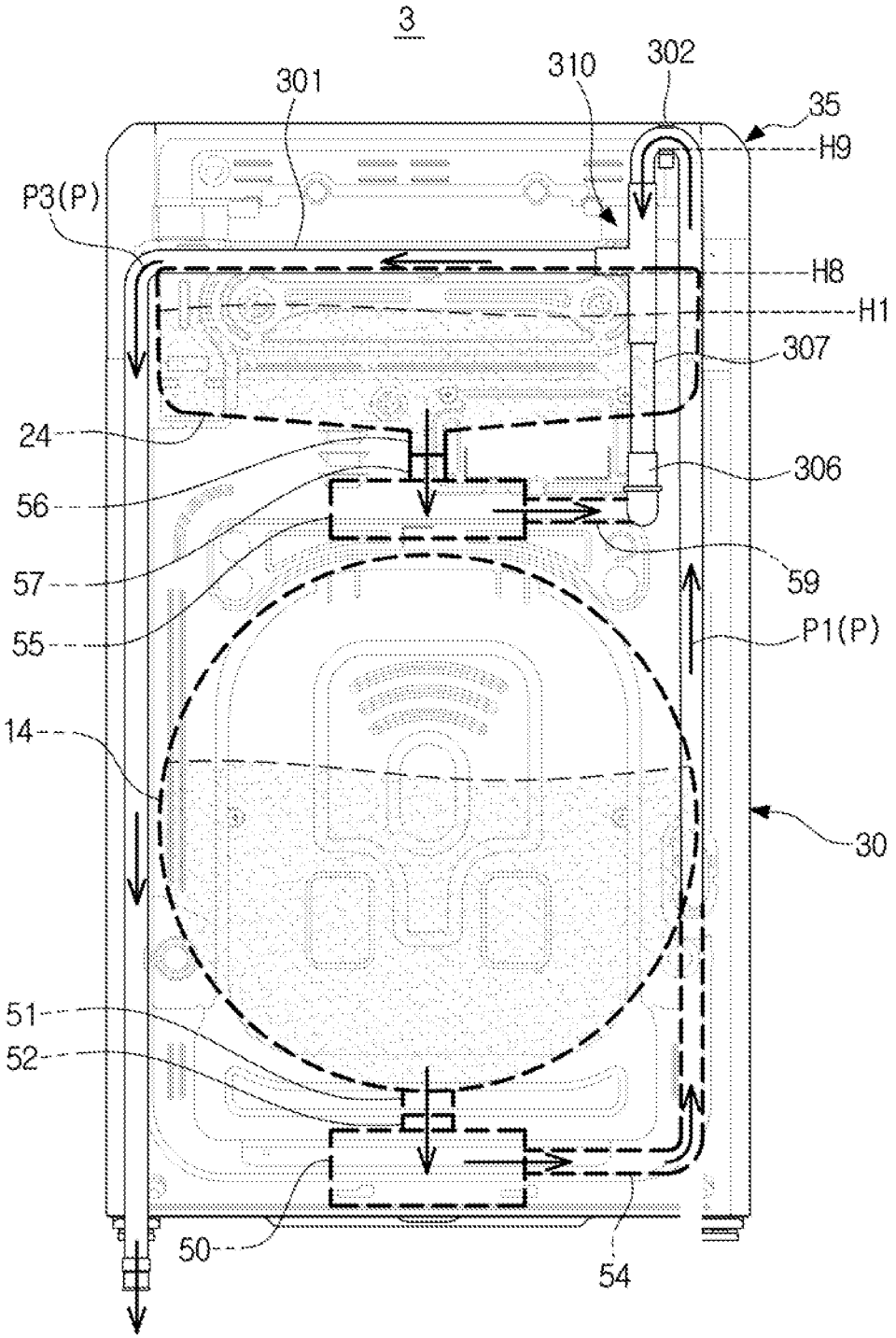
FIG. 11 is a rear view illustrating a drain path of a washing machine according to another embodiment of the present disclosure.
Figure 12:
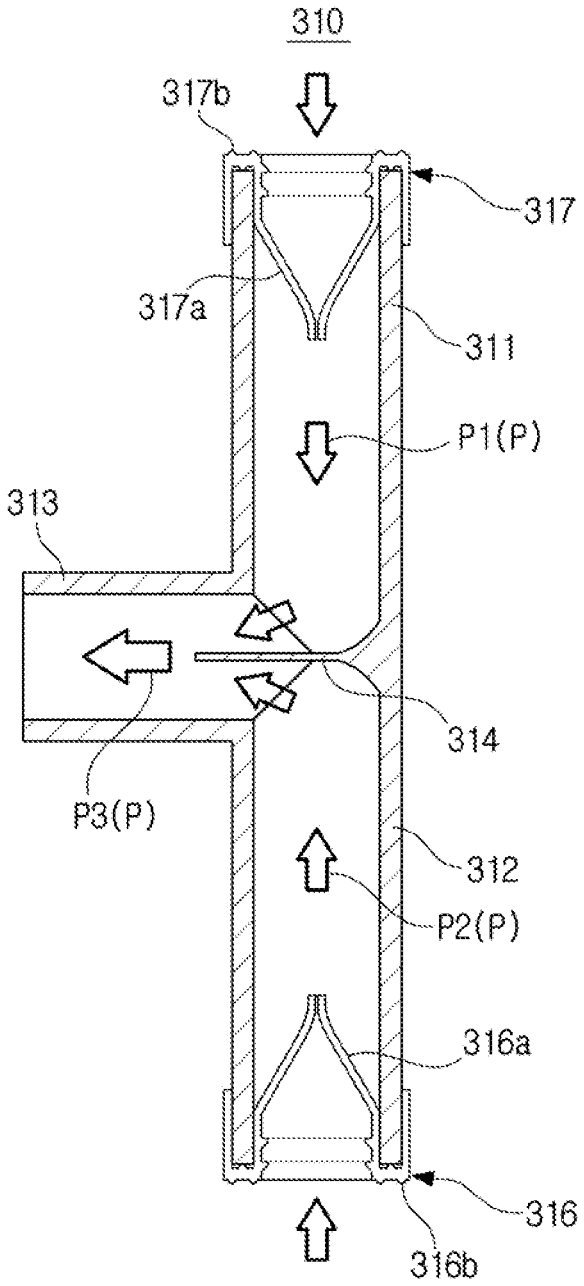
FIG. 12 is a cross-sectional view of a connector illustrated in FIG. 11.

FIG. 11 is a rear view illustrating a drain path of a washing machine 3 according to another embodiment of the present disclosure. FIG. 12 is a cross-sectional view of a connector 310 illustrated in FIG. 11.

Referring to FIGS. 11 and 12, the washing machine 3 will be described. The same reference numerals are given to the same components as components described above with reference to FIGS. 4 to 6, and descriptions thereof will not be repeated.

The connector 310 of the washing machine 3 may be coupled to the second housing 35. The connector 310 may be coupled to the second housing 35 by screw coupling. The connector 310 may include a first inlet pipe 311, a second inlet pipe 312, and an outlet 313.

The first inlet pipe 311 may be connected to the first drain hose 54 through which wash water of the first tub 14 is drained. At least one portion of the first drain hose 54 may be disposed at a position H9 higher than the maximum water storage height H1 of the second tub 24. That is, at least one portion of the first drain hose 54 may be fixed to the second housing 35 by a fixing member 302. Particularly, when wash water is drained through the third drain hose 301 from an upper portion of the washing machine 3, flowing of wash water caused by siphonage between the second tub 24 and the first tub 14 may be prevented in the washing machine 3 by locating at least one portion of the first drain hose 54 at the position H9 higher than the maximum water storage height H1 of the second tub 24.

The second inlet pipe 312 may be connected to an auxiliary hose 307 through which wash water of the second tub 24 is drained. Particularly, the second drain hose 59 may be coupled to an auxiliary pipe 306 coupled to an outer portion of the first housing 30. One end of the auxiliary pipe 306 may be connected to the second drain hose 59, and the other end of the auxiliary pipe 306 may be connected to the auxiliary hose 307. That is, wash water of the second tub 24 may flow into the second inlet pipe 312 of the connector 310 sequentially through the second drain hole 56, the second connection hose 57, the second drain pump 55, the second drain hose 59, the auxiliary pipe 306, and the auxiliary hose 307.

The outlet 313 may be connected to the third drain hose 301. The third drain hose 301 may guide wash water introduced through the first inlet pipe 311 and the second inlet pipe 312 out of the washing machine 3.

The connector 310 may be disposed at a position H8 higher than the maximum water storage height H1 of the second tub 24. That is, the outlet 313 of the connector 310 may be located at the position H8 higher than the maximum water storage height H1 of the second tub 24. In another aspect, at least one portion of the third drain path P3 may be located at the position H8 higher than the maximum water storage height H1 of the second tub 24.

According to this configuration, the washing machine 3 may prevent wash water from being flowing out of the washing machine 3 through the second drain path P2 and the third drain path P3 while water is supplied into the second tub 24. That is, since at least one portion of the third drain path P3 is located at the position H8 higher than the maximum water storage height H1 of the second tub 24, wash water cannot fill the entire third drain hose 301 even in the case where water is supplied into the second tub 24. Thus, the washing machine 3 may prevent wash water from being drained by siphonage.

The connector 310 may include a guide rib 314 provided at a position where the first drain path P1 and the second drain path P2 are joined and guiding wash water introduced through the first inlet pipe 311 to the outlet 313 and wash water introduced through the second inlet pipe 312 to the outlet 313. The guide rib 314 may extend toward the outlet 313 from an inner surface of the connector 310. That is, the guide rib 314 may extend by a predetermined length in a flowing direction of wash water in the third drain path P3.

The connector 310 may include a first check valve 316. The first check valve 316 may be disposed at the second drain path P2. The first check valve 316 may include a first opening/closing unit 316*a* and a first sealing protrusion 316*b*.

However, when the washing machine 3 includes a drying apparatus as illustrated in FIG. 8, the first check valve 316 may be dispensed with to efficiently discharge hot air from the first tub 14.

The connector 310 may include a second check valve 317. The second check valve 317 may be disposed at the first drain path P1. The second check valve 317 may include a second opening/closing unit 317*a* and a second sealing protrusion 317*b*. However, the second check valve 317 may be dispensed with, if required. Specifically, when the third drain hose 301 guides wash water downward from the washing machine 3, there is a very low possibility that wash water remaining in the third drain hose 301 flows backward into the first tub 14 through the first drain path P1 in the case of stopping drainage. In this case, the second check valve 317 may be dispensed with.

The configurations of the first check valve 316 and the second check valve 317 are substantially the same as those of the first check valve 116 and the second check valve 117 described above with reference to FIGS. 4 to 6, and thus detailed descriptions thereof will not be repeated.

Figure 13:
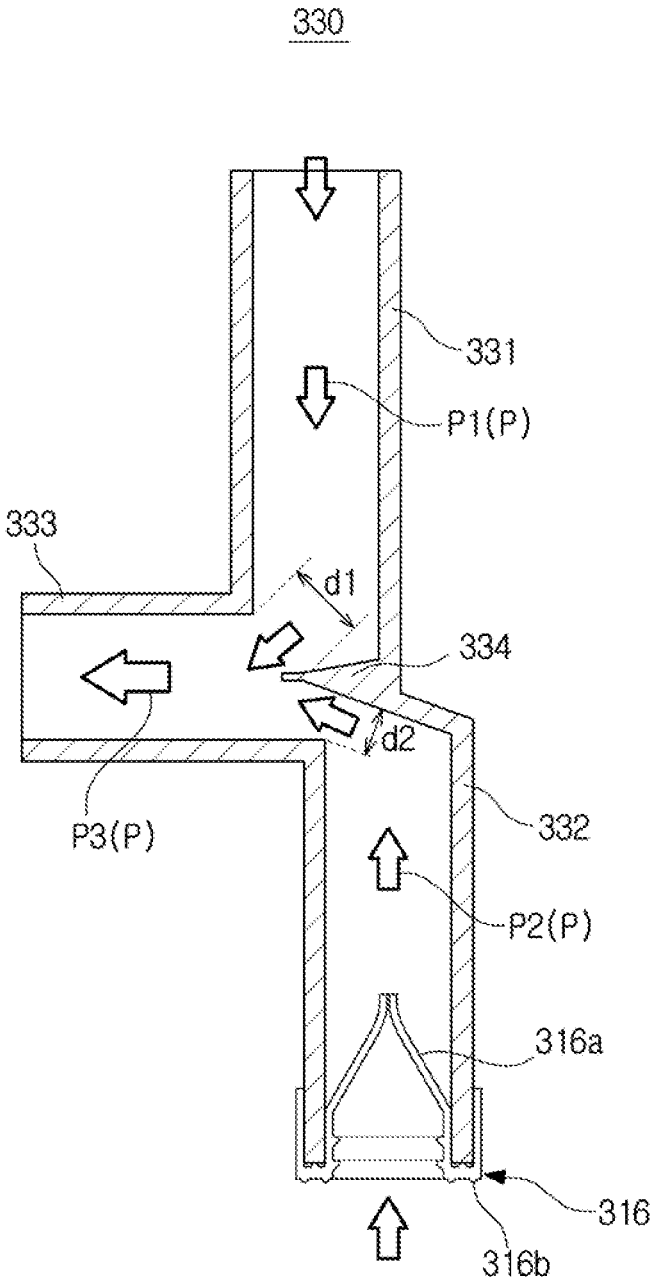
FIG. 13 is a view illustrating another example of the connector illustrated in FIG. 12.

FIG. 13 is a view illustrating another example of the connector 310 illustrated in FIG. 12.

The washing machine 3 may include a connector 330 having an improved backflow preventing effect. Specifically, the connector 330 may be provided such that a first diameter d1 of a pipe through which wash water introduced via a first inlet pipe flows to an outlet 333 is different from a second diameter d2 of a pipe through which wash water introduced via a second inlet pipe P2 flows to the outlet pipe P3. Specifically, the first diameter d1 may be greater than the second diameter d2.

According to this configuration, a flow rate of wash water passing through the relatively smaller pipe having the second diameter d2 increases by the Venturi effect in the washing machine 3 so that a pressure of a portion of wash water from the second inlet pipe 332 to the outlet 333 decreases. Thus, the backflow of wash water into the second tub 24 may be prevented more efficiently.

As is apparent from the above description, according to the washing machine according to the present disclosure, laundry may be washed separately, if required, by using a plurality of washing apparatuses.

According to the washing machine according to the present disclosure, manufacturing costs may be reduced since wash water is drained by using a single drain hose by connecting drain hoses to drain wash water of the plurality of tubs with each other using a connector.

According to the washing machine according to the present disclosure, siphonage among the plurality of washing apparatuses may be prevented without using a separate control valve by disposing at least one portion of a drain path at a position higher than a maximum water storage height of an upper tub.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a first housing;

a second housing disposed above the first housing;

a first tub included in the first housing and having a first opening formed at a front surface thereof;

a second tub included in the second housing and having a second opening formed at an upper surface thereof;

a drain path to drain wash water from the first tub and wash water from the second tub; and a connector coupled to the first housing and disposed at one portion of the drain path where the wash water of the first tub and the wash water of the second tub are joined, wherein the drain path comprises:

a first drain path through which the wash water from the first tub flows to the connector;

a second drain path through which the wash water from the second tub flows to the connector; and a third drain path through which the wash water introduced into the connector through the first drain path and the second drain path flows out from the connector, and wherein at least one portion of the drain path is located at a position higher than a maximum water storage height of the second tub.

2. The washing machine according to claim 1, wherein at least one portion of the third drain path is located at a position higher than the maximum water storage height of the second tub.

3. The washing machine according to claim 1, wherein the connector comprises:

a first inlet pipe to form the second drain path; and a first check valve detachable from or attachable to the first inlet pipe and configured to prevent a backflow of the wash water from the second tub in a direction opposite to a drain direction.

4. The washing machine according to claim 3, wherein the first check valve comprises a sealing protrusion which protrudes from a surface in contact with the first inlet pipe.

5. The washing machine according to claim 3, further comprising a drain bracket disposed in the first housing, coupled to the connector, and having an insertion pipe inserted into the first check valve.

6. The washing machine according to claim 3, wherein the connector comprises a second check valve disposed at the first drain path and configured to prevent a backflow of the wash water from the first tub in a direction opposite to the drain direction.

7. The washing machine according to claim 6, wherein the connector further comprises a second inlet pipe to form the first drain path and the second check valve is detachable from or attachable to the second inlet pipe of the connector.

8. The washing machine according to claim 6, wherein at least one of the first check valve and the second check valve is formed of an elastic material.

9. The washing machine according to claim 1, wherein at least one portion of the second drain path is located at a position higher than the maximum water storage height of the second tub.

10. The washing machine according to claim 9, wherein the connector comprises a guide rib disposed at a portion thereof where the first drain path and the second drain path are joined and configured to guide the wash water introduced into the connector through the first drain path to the third drain path to prevent a backflow of the wash water introduced into the connector through the first drain path into the first tub.

11. The washing machine according to claim 9, wherein the connector further comprises a first check valve disposed at the second drain path and configured to prevent a backflow of the wash water from the second tub in a direction opposite to the drain direction.

12. The washing machine according to claim 9, wherein the connector further comprises a second check valve formed at the third drain path and configured to prevent a backflow of the wash water from the first tub in a direction opposite to the drain direction.

13. The washing machine according to claim 1, wherein at least one portion of the first drain path is located at a position higher than a maximum water storage height of the first tub.

14. The washing machine according to claim 1, wherein the connector is coupled to an outer portion of the first housing at a position higher than a maximum water storage height of the first tub.

15. The washing machine according to claim 1, wherein the first drain path is formed by a first drain hose which connects to the first tub and the connector, the second drain path is formed by a second drain hose which connects to the second tub and the connector, and the third drain path is formed by a third drain hose which connects to the connector to drain out the wash water that are joined at the one portion of the drain path.

16. The washing machine according to claim 15, wherein the connector includes a first inlet which connects to the first drain hose, a second inlet which connects to the second drain hose, and an outlet which connects to the third drain hose.

17. The washing machine according to claim 1, wherein the first drain path is formed by a first drain pipe which connects to the first tub and the connector, the second drain path is formed by a second drain pipe which connects to the second tub and the connector, and the third drain path is formed by a third drain pipe which connects to the connector to drain out the wash water that are joined at the one portion of the drain path.

18. The washing machine according to claim 17, wherein the connector includes a first inlet which connects to the first drain pipe, a second inlet which connects to the second drain pipe, and an outlet which connects to the third drain pipe.

19. A washing machine comprising:

a first housing;

a second housing disposed above the first housing;

a first tub included in the first housing;

a second tub included in the second housing;

a first drain path through which wash water from the first tub flows;

a second drain path through which wash water from the second tub flows;

a connector to connect to the first drain path and the second drain path; and a third drain path through which wash the water introduced into the connector though the first drain path and the second drain path flows out, wherein the first drain path is formed between the first tub and the connector so that the wash water from the first tub flows to the connector therethrough, the second drain path is formed between the second tub and the connector so that the wash water from the second tub flows to the connector therethrough, and the third drain path is formed between the connector and outside of the washing machine so that the wash water introduced into the connector through the first drain path and the second drain path flows out from the connector to the outside therethrough, and wherein at least one portion of the third drain path is located at a position higher than a maximum water storage height of the second tub and the connector in order to prevent the wash water from the second tub from draining out through the third drain path while water is supplied into the second tub.

20. The washing machine according to claim 19, wherein the connector comprises:

a first inlet pipe to form the second drain path;

a second inlet pipe to form the first drain path;

a first check valve detachable from or attachable to the first inlet pipe and configured to prevent a backflow of the wash water from the first inlet pipe in a direction opposite to a drain direction; and a second check valve detachable from or attachable to the second inlet pipe and configured to prevent a backflow of the wash water from the second inlet pipe in a direction opposite to a drain direction.

21. The washing machine according to claim 20, wherein the first check valve comprises a sealing protrusion which protrudes from a surface in contact with the first inlet pipe.

22. A washing machine comprising:

a first housing;

a second housing disposed above the first housing;

a first tub included in the first housing;

a second tub included in the second housing;

a first drain hose through which wash water from the first tub flows;

a second drain hose through which wash water from the second tub flows;

a connector to connect to the first drain hose and the second drain hose; and a third drain hose through which the wash water introduced into the connector though the first drain hose and the second drain hose flows out, wherein the first drain hose is connected to the first tub and the connector so that the wash water from the first tub flows to the connector therethrough, the second drain hose is connected to the second tub and the connector so that the wash water from the second tub flows to the connector therethrough, and the third drain hose is connected to the connector and outside of the washing machine so that the wash water introduced into the connector through the first drain hose and the second drain hose flows out from the connector to the outside therethrough, and wherein at least one portion of the second drain hose is located at a position higher than a maximum water storage height of the second tub and the connector in order to prevent the wash water from the second tub from draining out through the third drain hose while water is supplied into the second tub.

23. The washing machine according to claim 22, wherein the connector comprises:

a guide rib disposed at a portion thereof where the first drain hose and the second drain hose are joined and configured to guide the wash water introduced into the connector through the first drain hose to the third drain hose to prevent a backflow of the wash water introduced into the connector through the first drain hose into the first tub; and a first check valve disposed at the second drain hose and configured to prevent a backflow of the wash water from the second tub in a direction opposite to a drain direction.

* * * * *